United States Patent [19]

Pierson

[11] 4,142,263

[45] Mar. 6, 1979

[54] BED-MATTRESS ELEVATING SYSTEM AND THE LIKE

[75] Inventor: Olof P. Pierson, Caribou, Me.

[73] Assignee: Maine Ideas Incorporated, Caribou, Me.

[21] Appl. No.: 854,532

[22] Filed: Nov. 25, 1977

[51] Int. Cl.[2] ..... A61G 7/10; A47G 9/00

[52] U.S. Cl. ..... 5/68; 5/327 R

[58] Field of Search ..... 5/63, 66–68, 5/284, 337, 338, 365, 327 R, 327 B

[56] References Cited

U.S. PATENT DOCUMENTS

| | | | |
|---|---|---|---|
| 3,606,623 | 9/1971 | Aymor | 5/68 |
| 3,781,928 | 1/1974 | Swallert | 5/68 |
| 3,879,772 | 4/1975 | Pol | 5/68 |
| 3,900,910 | 8/1975 | Nakata | 5/337 |

*Primary Examiner*—Casmir A. Nunberg

*Attorney, Agent, or Firm*—Rines and Rines, Shapiro and Shapiro

[57] ABSTRACT

This disclosure is concerned with improvements in mechanisms for elevating a mattress on a bed by a simple inflatable pillow inserted under the mattress and of novel prismatic geometrical construction enabling highly flexible adaptability of use and simplicity of operation.

5 Claims, 1 Drawing Figure

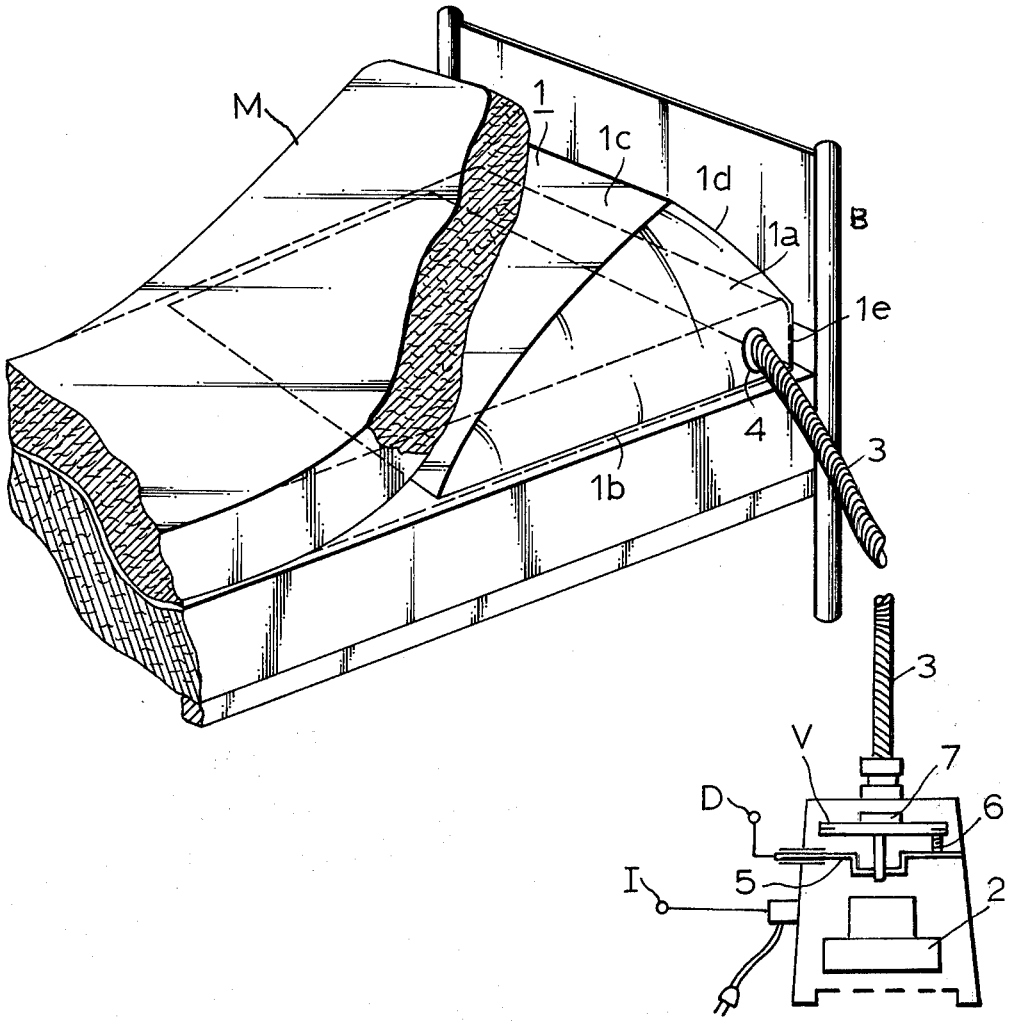
M
1
1c
1d
1a
B
1e
4
3
1b
3
V
7
D
6
I
5
2

BED-MATTRESS ELEVATING SYSTEM AND THE LIKE

The present invention relates to bed-mattress elevating systems and the like, being more particularly concerned with portable systems involving inflatable elevating mechanisims and readily applicable to and removable from existing bed-mattress units so as to imbue fixed home or hospital beds with the flexibility of ready mattress elevation, as in the mattress parts supporting the head and shoulders, for example, and within a wide elevational angular range.

While it has previously been proposed to provide such inflatable mattress-elevating systems, as disclosed, for example, in U.S. Pat. Nos. 2,769,183, 3,606,623, and 3,781,928, such devices have inherently required multiple inflatable bellow constructions and/or complicated lifting frames and similar mechanisms which have heretofore practically inhibited their general use—certainly in the home.

Underlying the present invention, on the other hand, is the discovery of a highly novel and effective geometrical and rather critical relative dimensional prismatic pillow construction that, apparently, for the first time, enables a light-weight flexible, inflatable pillow to become imbued with sufficient mechanical surface lifting and supporting properties to raise and stably hold the usual range of home and hospital bed mattresses, doing so with simple, deflated-condition insertion under the mattress, and with extremely facile air-supply controls.

It will be evident that ordinary types of pillow constructions fall far short of such properties and, of course, are useless except as a wedge or prop; and the above-cited illustrative patents show that, prior to the present invention, it was thought that only a series of bellows or complicated frame and lifting supports could achieve this result. The fact that such lightweight apparatus can now effectively be used, indeed, is opening up the application of these important functions for ready home and hospital use and the like.

An object of the present invention, accordingly, is to provide a new and improved bed-mattress elevating system and the like, not subject to the complications of the prior art, as above summarized, but enabling the use of a simple, light-weight, flexible pillow of novel construction and shape for positive elevational control and support.

A further object is to provide a novel inflatable pillow system of more general utility, as well.

Other and further objects will be explained hereinafter and are more particularly pointed out in the appended claims. In summary, however, from one of its important aspects, the invention is concerned with improvements in a bed-mattress elevating system and the like embodying an inflatable pillow of flexible material having, when inflated, a prismatic configuration provided with four-sided end wall panels and comprising four successively connected rectangular wall panels bounding the pillow between the end wall panels, the rectangular wall panel forming the bottom of the pillow being connected along its forward edge to a front rectangular wall panel extending rearwardly upwardly at an acute angle and the top edge of which connects to an upper rearward rectangular wall panel sloping downwardly almost substantially normally to the said front wall panel and then connecting with a lower rearward rectangular wall panel extending substantially vertically downward to meet the rear edge of the said bottom wall panel substantially normally, the pillow being adapted for insertion, in deflated condition, with the bottom and from rectangular wall panels placed between the bottom of the mattress and the mattress support and the upper rearward wall panel near the headboard region of the bed in order, upon inflation of the pillow, to raise the part of the mattress near the headboard, and means for enabling inflation and deflation of the inserted pillow.

The invention will now be explained in connection with the accompanying drawing, the single figure of which illustrates the same in preferred form.

Referring to the drawing, the novel flexible, inflatable pillow of the invention is shown at 1 in an inflated condition (which can be adjusted to any desired degree of inflation and thus elevational angle of the mattress M), being illustrated as applied near the headboard region of the bed B, to permit elevation of the head and shoulder-supporting parts of the mattress M, in this particular mode of use. As before stated, it was surprisingly found that with the particular geometrical and relative dimensional prismatic construction illustrated, a flexible, thin-walled, lightweight pillow could, when inflated from a position between the mattress and the bed springs, for example, provide the mechanical strength and surface uniformity to elevate and stably support a mattress across its full width, or any part thereof; and, upon deflation, collapse into an unobtrusively thin insert under the mattress.

The configuration required involves four-sided end wall panels 1*a*, closing off the pillow enclosure bounded by the prismatically formed (when inflated) four successively connected rectangular wall panels. The bottom rectangular wall panel 1*b* is connected along is forward (or left-hand) edge to the upwardly extending front rectangular wall panel 1*c* sloping at an acute angle to the bottom panel 1*b*. The top edge of the panel 1*c* connects with the upper rearward rectangular wall panel 1*d*, downwardly sloping, preferably almost normally (i.e. almost at substantially a right angle) to the front panel 1*c*, and then connecting with a lower rearward rectangular wall panel 1*e* extending substantially vertically downward to meet the rear (right-hand) edge of the bottom wall panel 1*b*, and adjacent the headboard of the bed B. In preferred form, it has been determined that the bottom and front panels 1*b* and 1*c* should be of substantially the same width, as shown, with the top edge of panel 1*c* located more than half-way towards the rear (i.e. towards the right in the drawing) of the bottom wall panel 1*b*, and with the upper rearward wall panel 1*d* somewhat wider than the lower rearward wall panel 1*e*. With such a construction, the pillow may be formed of such flexible air-holding materials as vinyl fabric-backed sheeting and the like without requiring frames or rib structures, and can provide the necessary uniform supporting pressures even over the extent of wide mattresses. Thus, when deflated and collapsed (shown in dotted lines) the panels fold into an unobtrusive, thin insert with panels 1*b* and 1*c* overlying each other under the mattress.

The control of the degree of inflation or deflation of the pillow 1, and thus the elevational state of the mattress M, is shown simply effected from an electrically operated air blower 2 feeding through a valve mechanism V to a flexible air hose 3 that detachably plugs into an inlet 4, preferably in an end wall 1*a* of the pillow 1. For a pillow of width dimensions (1*b* × 1*c* × 1*d* × 1*e*) of the order of 22 inches × 22 inches × 12½ inches ×

6 inches, 38 inches long (single bed), for example, a 1.1 horsepower ac/dc through-flow vacumm type series-motor blower, providing 100 CFM at 55 inches of water, was found most satisfactory. The user merely operates an "inflate" switch button I to turn the blower 2 on for any desired time of inflating; and deflation is effected by the control D, rotating a crank arm 5 to activate spring release at 6 of a valve diaphragm 7 to allow the air in the pillow to escape to any desired degree. Clearly other types of well-known air or other fluid-inflating and deflating mechanisms may also be employed, through the above system has advantages of simplicity of use, light-weight portability, and low cost. To accommodate right or left-hand attachment of the flexible air hose 3 to the pillow 1, each end wall panel 1*a* may be provided with an inlet 4, preferably of a converging tapered type, as shown, to receive and threadedly lock a tapered soft rubber or similar attachment plug, on the air hose 3, and with a tapered stopper provided for the end wall panel inlet 4 not in use.

While illustrated as disposed at the headboard, clearly the invention is useful for use at other parts of the bed, and on other types of structures, as well, where the operational features attained by the invention are desired.

Further modifications will also occur to those skilled in this art and such are considered to fall within the spirit and scope of the invention as defined in the appended claims.

What is claimed is:

1. In a bed-mattress elevating system and the like, an inflatable pillow of flexible material having, when inflated, a prismatic configuration provided with four-sided end wall panels and comprising four successively connected rectangular wall panels bounding the pillow between the end wall panels, the rectangular wall panel forming the bottom of the pillow being connected along its forward edge to a front rectangular wall panel extending rearwardly upwardly at an acute angle and the top edge of which connects to an upper rearward rectangular wall panel sloping downwardly almost substantially normally to the said front wall panel and then connecting with a lower rearward rectangular wall panel extending substantially vertically downward to meet the rear edge of the said bottom wall panel substantially normally, the pillow being adapted for insertion, in deflated condition, with the bottom and front rectangular wall panels placed between the bottom of the mattress and the mattress support and the upper rearward wall panel near the headboard region of the bed in order, upon inflation of the pillow, to raise the part of the mattress near the headboard, and means for enabling inflation and deflation of the inserted pillow.

2. A bed-mattress elevating system and the like as claimed in claim 1, wherein the said bottom and front wall panels are of substantially equal width greater than the width of each of the upper and lower rearward wall panels.

3. A bed-mattress elevating system and the like, as claimed in claim 2 wherein the said top edge of the said front wall panel is located more than half-way towards the rear of the said bottom wall panel and the said upper rearward wall panel is wider than the said lower rearward wall panel.

4. A bed-mattress elevating system and the like as claimed in claim 1 wherein the inflation and deflation means comprises valve-controlled blower means connected by flexible conduit means to inlet means provided in an end wall panel of the pillow.

5. A bed-mattress elevating system and the like as claimed in claim 4 and in which external control means is provided, connected with the valve-controlled blower means, for enabling the user, when resting on the mattress, to activate the blower means to inflate the pillow and thus raise the mattress, and to control the valve means to deflate the pillow and thus lower the mattress, to any desired degree.

* * * * *